US010428398B2

(12) United States Patent
Gleeson

(10) Patent No.: US 10,428,398 B2
(45) Date of Patent: Oct. 1, 2019

(54) ANIMAL HIDE DEHAIRING METHODS

(71) Applicant: National Beef Packing Company, LLC, Kansas City, MO (US)

(72) Inventor: Shaun Francis Gleeson, Kansas City, MO (US)

(73) Assignee: National Beef Packing Company, LLC, Kansas City, MO (US)

( * ) Notice: Subject to any disclaimer, the term of this patent is extended or adjusted under 35 U.S.C. 154(b) by 453 days.

(21) Appl. No.: 14/975,300

(22) Filed: Dec. 18, 2015

(65) Prior Publication Data

US 2017/0175210 A1 Jun. 22, 2017

(51) Int. Cl.
*C14C 1/06* (2006.01)
*C14C 3/06* (2006.01)

(52) U.S. Cl.
CPC ..... *C14C 1/065* (2013.01); *C14C 1/06* (2013.01); *C14C 3/06* (2013.01)

(58) Field of Classification Search
CPC ..... C14C 1/065; C14C 1/06; C14C 3/06
See application file for complete search history.

(56) References Cited

U.S. PATENT DOCUMENTS 5,525,509 A * 6/1996 Christner ..... C14C 1/08 435/198
2013/0102058 A1* 4/2013 Soerensen ..... C14C 1/065 435/265

FOREIGN PATENT DOCUMENTS

CN 102344975 * 2/2012 ..... C14C 1/06

OTHER PUBLICATIONS

Finger et al. Derwent 1980-18485C, 1980.*

* cited by examiner

*Primary Examiner* — Amina S Khan
(74) *Attorney, Agent, or Firm* — Seth Black; Dodd Call Black, PLLC

(57) ABSTRACT

Methods for preparing an animal hide for chrome tanning are provided. In particular, one or more embodiments include treating the hide with a first enzyme, a second enzyme, and a polysulfide. This treatment facilitates improved removal of hair from the hide. Furthermore, one or more embodiments include various combinations of treating the hide with a third enzyme, a liming agent, a pH-modifying agent, one or more sulfides, and one or more soaking agents. In addition, one or more embodiments include sanitizing the hide and liming the hide to further facilitate the processing of the animal hide into leather.

20 Claims, 6 Drawing Sheets

ANIMAL HIDE DEHAIRING METHODS

BACKGROUND

1. Technical Field

The present invention relates to the processing of animal hides. More specifically, the present invention relates to methods for preparing animal hides for chrome tanning.

2. Background and Relevant Art

Tanning is the process of transforming an animal hide into leather by treating the hide with chemicals that prevent the hide from decaying and make the hide supple and durable. Commonly, the hide is produced at a slaughterhouse where animals are slaughtered to harvest meat. However, the hide may also be produced at a facility where animals are slaughtered for reasons other than to harvest meat, such as a knackery or tannery. Thus, while the vast majority of leather is made from the hides of cattle, sheep, pigs, and goats, a wide assortment of leather is also produced from the hides of various other animals, such as deer, bison, buffalo, ostrich, kangaroo, crocodile, alligator, snake, eel, and stingray.

Following removal of the hide from an animal carcass, curing is used to prevent decomposition of the hide before the hide is subjected to further tanning processes. Examples of curing include treating the hide with salt or preserving the hide at a cold temperature, such as by packing the hide with ice. Accordingly, curing facilitates the preservation of the hide while it is transported to a tannery.

Once received at a tanning facility, the animal hide is subjected to processes that remove non-leather forming substances, such as hair and fat, from the hide. Such processes, which are generally referred to as beamhouse operations, may include trimming, fleshing, dehairing, liming, bating, deliming, and pickling. Trimming is performed to remove unwanted or unusable portions of the hide. Soaking is used to make the hide soft and flexible by reintroducing into the hide moisture lost in curing. Fleshing facilitates the penetration of chemicals into the hide by removing fat and other substances and may also be used to shape the hide into a uniform thickness. Dehairing removes hair and other non-leather forming substances from the hide by treating the hide with chemicals. Liming is the most common method of dehairing. Thermal, oxidative, and other chemical methods of hair removal are also used for this purpose, as are mechanical processes of dehairing, called scudding. Liming is also employed to swell and break up tissue fibers in the hide, as well as prepare the collagen in the hide for proper tanning. Bating and deliming involves treating the hide with enzymes that remove undesirable components of the tissue of the hide to make the hide soft, stretchable, and flexible. Pickling is used to preserve the hide or prepare the hide for tanning by changing the acidity of the hide.

Following beamhouse operations, the animal hide is tanned using one of two chemical tanning processes: chrome tanning or vegetable tanning. These create a reaction between collagen fibers of the hide and chemical tanning agents. Chrome tanning involves treating the hide with chromium, whereas vegetable tanning involves treating the hide with vegetable tannins. Other tanning agents are also used, such as alum, syntans, formaldehyde, glutaraldehyde, and heavy oils. Once tanning is complete, the tanned hide may be processed further before being made into finished leather. Further processing involves wringing, grading, splitting, and shaving of the tanned hide. Finally, the tanned hide is subjected to retanning, coloring, fatliquoring, and finishing processes that produce finished leather.

SUMMARY

According to teachings of the present invention, a method for preparing an animal hide for chrome tanning includes the step of treating the hide with a first enzyme, and thereafter, the step of treating the hide with a second enzyme and the step of treating the hide with a polysulfide. When the step of treating with the polysulfide occurs after the step of treating with the second enzyme, the step of treating with the first enzyme includes the step of contacting the hide with the first enzyme, the step of contacting the hide with a first soaking agent, and the step of mixing together the hide, the first enzyme, and the first soaking agent. In one embodiment of such a method, the step of treating with the second enzyme involves the step of contacting the hide with the second enzyme, the step of contacting the hide with a third enzyme, and the step of mixing together the hide, the second enzyme, and the third enzyme.

Optionally, in the inventive method, following the step of treating with the second enzyme, but before the step of treating with the polysulfide, additional steps are employed. These may include the step of contacting the hide with a pH-modifying agent, the step of contacting the hide with a first soaking agent, the step of contacting the hide with a second soaking agent, and the step of mixing together the hide, the pH-modifying agent, the first soaking agent, and the second soaking agent.

Alternatively, the step of treating with the polysulfide occurs before the step of treating with the second enzyme. Then, the step of treating with the polysulfide involves the step of contacting the hide with the polysulfide, the step of contacting the hide with a third soaking agent, and the step of mixing together the hide, the polysulfide, and the third soaking agent; and the step of treating with the first enzyme involves the step of contacting the hide with the first enzyme, the step of contacting the hide with a pH-modifying agent, and the step of mixing the hide, the first enzyme, and the pH-modifying agent.

Yet another version of such a method utilizes the step of contacting the hide with a third soaking agent after the step of treating with the first enzyme but before the step of treating with the polysulfide, the step of mixing the hide and the third soaking agent, the step of contacting the hide with a liming agent after the step of treating with the polysulfide but before the step of treating with the second enzyme, and mixing together the hide and the liming agent.

According to another more specific aspect of the present invention, a method for preparing an animal hide for chrome tanning entails depositing the hide into a treatment container, depositing a glycosylase enzyme into the treatment container, and agitating the treatment container for a first duration subsequent to both the step of depositing the hide and the step of depositing the glycosylase enzyme. Thereafter, this specific aspect of the present invention resumes by depositing a first peptidase enzyme into the treatment container, agitating the treatment container for a second duration after the step of depositing the first peptidase enzyme, depositing a polysulfide into the treatment container after the step of agitating for the second duration, and agitating the treatment container for a third duration after the step of depositing the polysulfide.

Optionally, before the step of agitating for the first duration, a first soaking agent is deposited into the treatment container, while the step of agitating for the first duration mixes the hide, the glycosylase enzyme, and the first soaking agent. Before the step of agitating for the second duration, a second peptidase enzyme is deposited into the treatment container, while the step of agitating for the second duration mixes the hide, the first peptidase enzyme, and the second peptidase enzyme. Prior to depositing the glycosylase enzyme, a detergent is deposited into the treatment container, a pesticide is deposited into the treatment container, and the treatment container is agitated for a fourth duration after the detergent and the pesticide are in the treatment container. After the step of agitating for the third duration, a first sulfide is deposited into the treatment container, a second sulfide into the treatment container, a first soaking agent is deposited into the treatment container, and the treatment container is agitated for a fifth duration after the first sulfide, the second sulfide, and the first soaking agent are in the treatment container.

According to yet another specific aspect of the present invention, a method for preparing an animal hide for chrome tanning includes the steps of depositing the hide into a treatment container, depositing an esterase enzyme into the treatment container, and agitating the treatment container for a first duration after the step of depositing the hide and the step of depositing the esterase enzyme. Thereafter, this specific aspect of the present invention resumes by depositing a polysulfide into the treatment container and agitating the treatment container for a second duration after the step of depositing the polysulfide. After the step of agitating for the second duration, a peptidase enzyme is deposited into the treatment container and the treatment container is agitated for a third duration after the step of depositing the peptidase enzyme. Before the step of agitating for the first duration, a pH-modifying agent is deposited into the treatment container, while the step of agitating for the first duration causes mixing of the hide, the esterase enzyme, and the pH-modifying agent.

Optionally, before the step of agitating for the second duration a soaking agent is deposited into the treatment container, while the step of agitating for the second duration causes the hide, the polysulfide, and the soaking agent to be mixed together. Before the step of agitating for the third duration, a sulfide is deposited into the treatment container, while in the step of agitating for the third duration the hide, the peptidase enzyme, and the sulfide are mixed together. Before the esterase enzyme is deposited in the treatment container, a pH-modifying agent is deposited into the treatment container, a pesticide is deposited into the treatment container, and the treatment container is agitated for a fourth duration with the pH-modifying agent and the pesticide in there. Before the step of depositing the peptidase enzyme but after the step of agitating for the second duration, a liming agent is deposited into the treatment container, and the treatment container with the first liming agent therein is agitated for a fifth duration.

In light of the foregoing, additional features and advantages of exemplary embodiments will be set forth in the description which follows, and in part will be obvious from the description, or may be learned by the practice of such exemplary embodiments. The features and advantages of such embodiments may be realized and obtained by means of the instruments and combinations particularly pointed out in the appended claims. These and other features will become more fully apparent from the following description, or may be learned by the practice of such exemplary embodiments as set forth hereinafter.

BRIEF DESCRIPTION OF THE DRAWINGS

In order to describe the manner in which the above recited and other advantages and features can be obtained, a more particular description will be rendered by reference to specific embodiments thereof that are illustrated in the appended drawings. It should be noted that the figures are not drawn to scale, and that elements of similar structure or function are generally represented by like reference numerals for illustrative purposes throughout the figures. Understanding that these drawings depict only typical embodiments and are not therefore to be considered to be limiting, such embodiments will be described and explained with additional specificity and detail through the use of the accompanying drawings in which.

DETAILED DESCRIPTION

Embodiments of the present invention improve the preparation of an animal hide for chrome tanning. In particular, embodiments of the present invention facilitate the removal of hair and other non-leather forming substances from an animal hide by treating the hide with a first enzyme, a second enzyme, and a polysulfide. For example, a hide is prepared for chrome tanning by first treating the hide with a first enzyme, followed by treating the hide with a second enzyme, which is then followed by treating the hide with a polysulfide. As another example, a hide is prepared for chrome tanning by first treating the hide with a first enzyme, followed by treating the hide with a polysulfide, which is then followed by treating the hide with a second enzyme.

Figure 1:
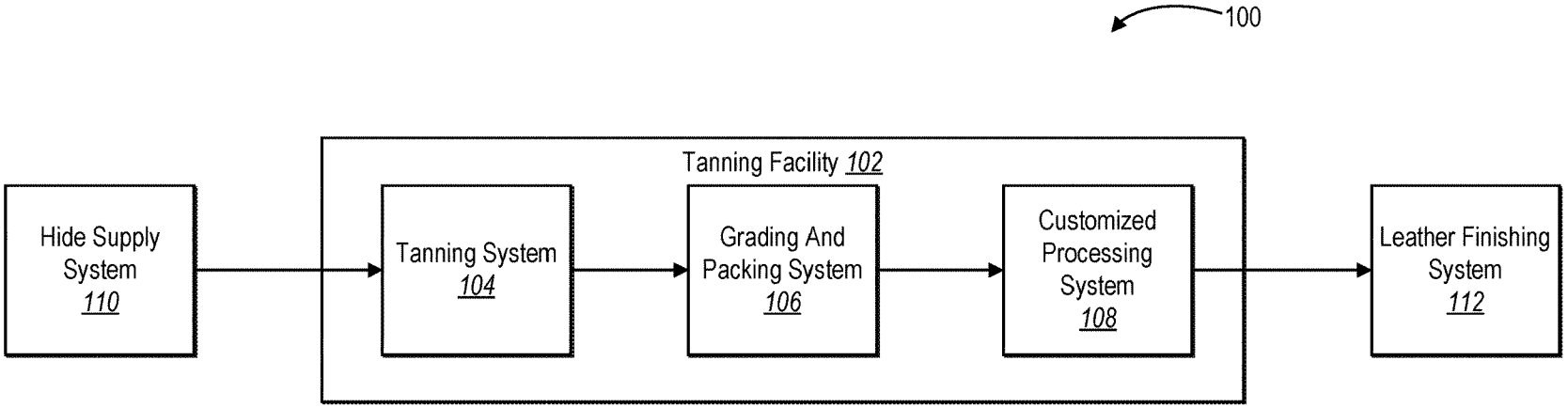
FIG. 1 is a schematic diagram of a system for processing animal hides into leather in accordance with embodiments of the present invention.

FIG. 1 is a schematic diagram illustrating a tannery system 100 for processing animal hides into leather in accordance with embodiments of the present invention. An overview of tannery system 100 will be described next in relation to FIG. 1. Thereafter, a more detailed description of the components and processes of tannery system 100 will be described in relation to the remaining figures.

As illustrated by FIG. 1, tannery system 100 includes tanning facility 102. Tanning facility 102 includes more or fewer systems, processes, machinery, and apparatuses, though in most embodiments tanning facility 102 includes at least tanning system 104. As illustrated in FIG. 1, tanning facility 102 includes grading and packing system 106 and customized processing system 108. Moreover, as FIG. 1 illustrates, tannery system 100 includes hide supply system 110 and leather finishing system 112.

Hide supply system 110 in FIG. 1 provides an animal hide obtained from the slaughter of an animal to tanning system 104 of tanning facility 102. Tanning system 104 employs various tanning systems, processes, machinery, and apparatuses to transform the animal hide into a tanned hide. After tanning system 104 produces a tanned hide, grading and packing system 106 receives the tanned hide and then grades, folds, stacks, and packs the tanned hide. After the tanned hide is graded and packed by grading and packing system 106, customized processing system 108 provides further processing, such as trimming and splitting, according to customized specifications. Following processing by customized processing system 108, leather finishing system 112 produces finished leather from the tanned hide.

Figure 2:
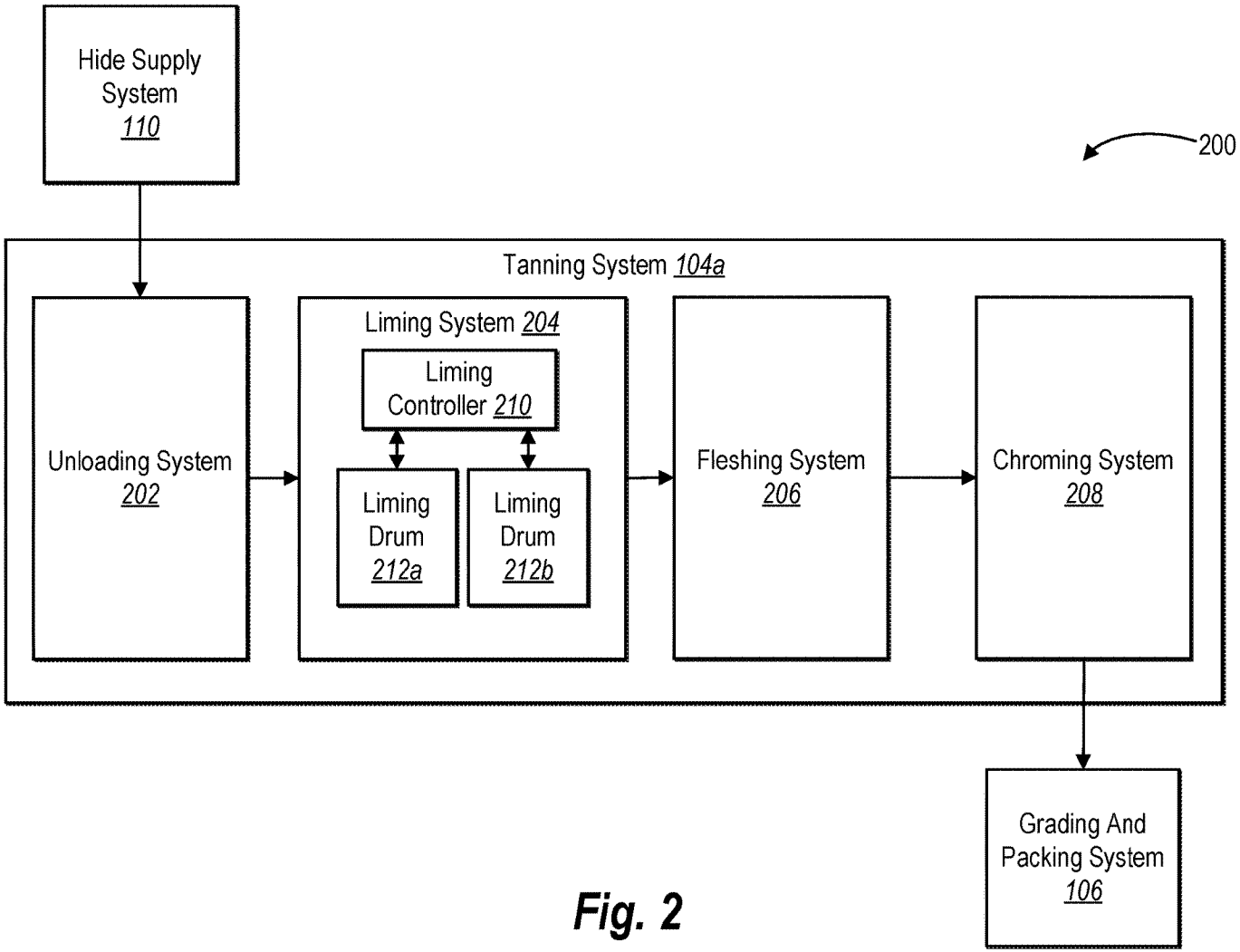
FIG. 2 is a detailed schematic diagram of an embodiment of a tanning system, such as the tanning system of FIG. 1.

FIG. 2 is a detailed schematic diagram of a second tannery system 200 that illustrates one embodiment of tannery system 100 and a method for processing an animal hide into leather according to teachings of the present invention. FIG. 2 further includes tanning system 104*a*, which is one embodiment of tanning system 104 of FIG. 1. As shown by FIG. 2, tanning system 104*a* includes unloading system 202, liming system 204, fleshing system 206, and chroming system 208. Unloading system 202, liming system 204, fleshing system 206, and chroming system 208 are connected by way of multiple conveyor systems.

FIG. 2 further illustrates that unloading system 202 receives an animal hide from hide supply system 110. After receiving the hide from hide supply system 110, unloading system 202 unloads and measures the hide. Unloading system 202 then provides the hide to a conveyor system that transports the hide to liming system 204. Liming system 204 receives the hide from unloading system 202 by way of a conveyor system. Then liming system 204 performs a liming process on the hide according to one or more liming recipes that will be disclosed in detail subsequently below. Liming system 204 then provides the hide to a conveyor system that transports the hide to fleshing system 206.

Fleshing system 206 receives the hide from liming system 204 by way of a conveyor system. Fleshing system 206 performs a fleshing process on the hide, which removes excess flesh, hair, and other material from the hide. Following the fleshing process, fleshing system 206 provides the hide to a conveyor system that transports the hide to chroming system 208. Chroming system 208 receives the hide from fleshing system 206 by way of a conveyor system. Then chroming system 208 performs a chroming process on the hide according to one or more chroming recipes. Chroming system 208 then provides the hide to grading and packing system 106, for example, by using another conveyor system.

As also shown in FIG. 2, tanning system 104*a* includes liming system 204. In particular, liming system 204 includes liming controller 210 that communicates with, monitors, and controls one or more liming drums 212*a*-212*b*. Although FIG. 2 illustrates that liming system 204 includes two liming drums 212*a*-212*b*, it should be understood that liming system 204 can include any number of liming drums, including even a single liming drum. Examples of liming drums 212*a*-212*b* may include but are not limited to drums made by Gozzini 1906 Turini Group S.R.L., Hüni A.G., Pajusco Tecnologie S.P.A., Poletto S.T.A. S.R.L., and Vallero International S.P.A.

Figure 3:
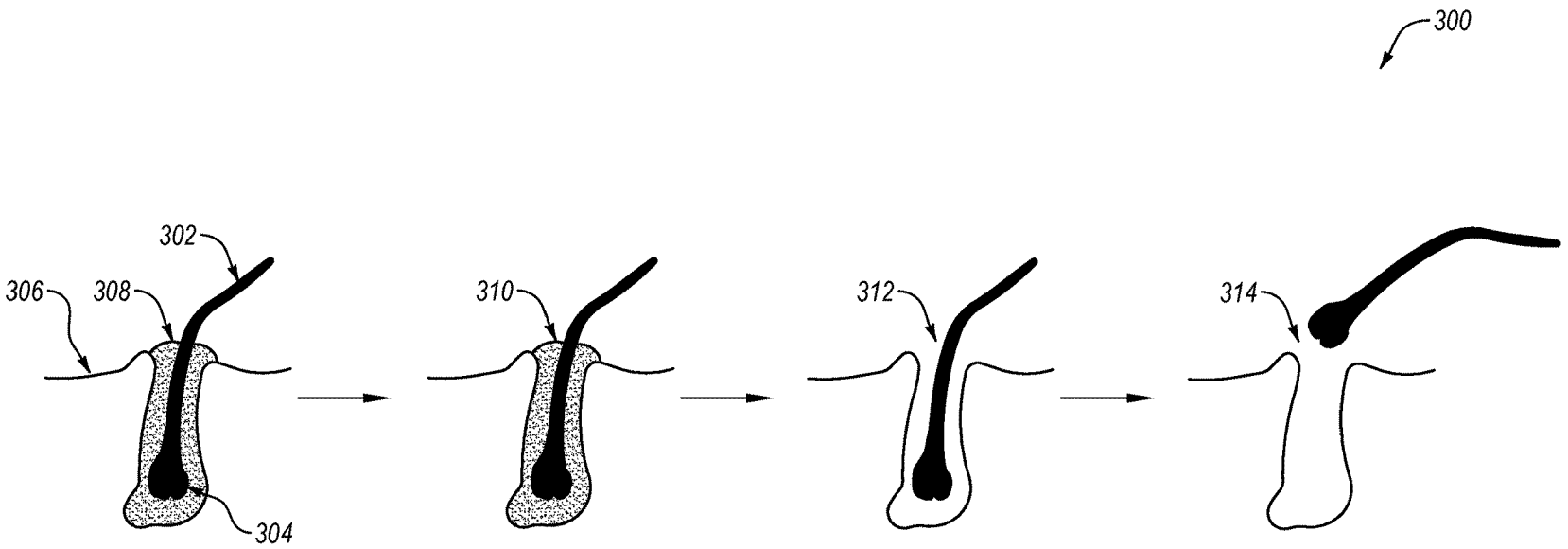
FIG. 3 illustrates stages in the progression of hair removal from an animal hide in accordance with embodiments of the present invention.

FIG. 3 illustrates stages in the progression of hair removal from an animal hide in accordance with embodiments of the present invention. As indicated by progression 300, hair on an animal hide includes hair shaft 302, hair root 304, skin 306, and surrounding structure 308. As used herein, surrounding structure means any material surrounding hair root 302 and the unexposed portion of hair shaft 302 inside skin 306.

As FIG. 3 further illustrates, one or more enzymes come in contact 310 with support structure 308, thereby weakening or removing support structure 308 from skin 306. Following the weakening or removal of support structure 308, a sulfide (e.g., polysulfide) comes in contact 312 with skin 306 and the hair, including hair shaft 302 and hair root 304. Thus, the contact 312 of the sulfide with the hair shaft 302, hair root 304, and skin 306 facilitates removal of the hair 314.

Moreover, it is important to appreciate that the hair and skin of animals varies throughout the year. In some instances, the hair and skin varies due to the changing seasons and associated weather conditions. In other instances, the hair and skin varies due to the diet of the animals. Accordingly, the hair, including hair shaft 302 and hair root 304, as well as skin 306 and support structure 308 of FIG. 3 can likewise vary throughout the year. For example, the amount of grease and fat in the skin 306 and support structure 308 can vary. In other instances, the thickness of the hair shaft 302 and hair root 304 can vary. In response to this variation, it is often desirable to modify the methods used to dehair animal hides. More specifically, the dehairing recipe, such as the liming recipe, is often modified in terms of the chemicals used, the duration of exposure of the chemicals to the hides, and the amount or magnitude of the mechanical agitation of the hides and the chemicals.

Figure 5:
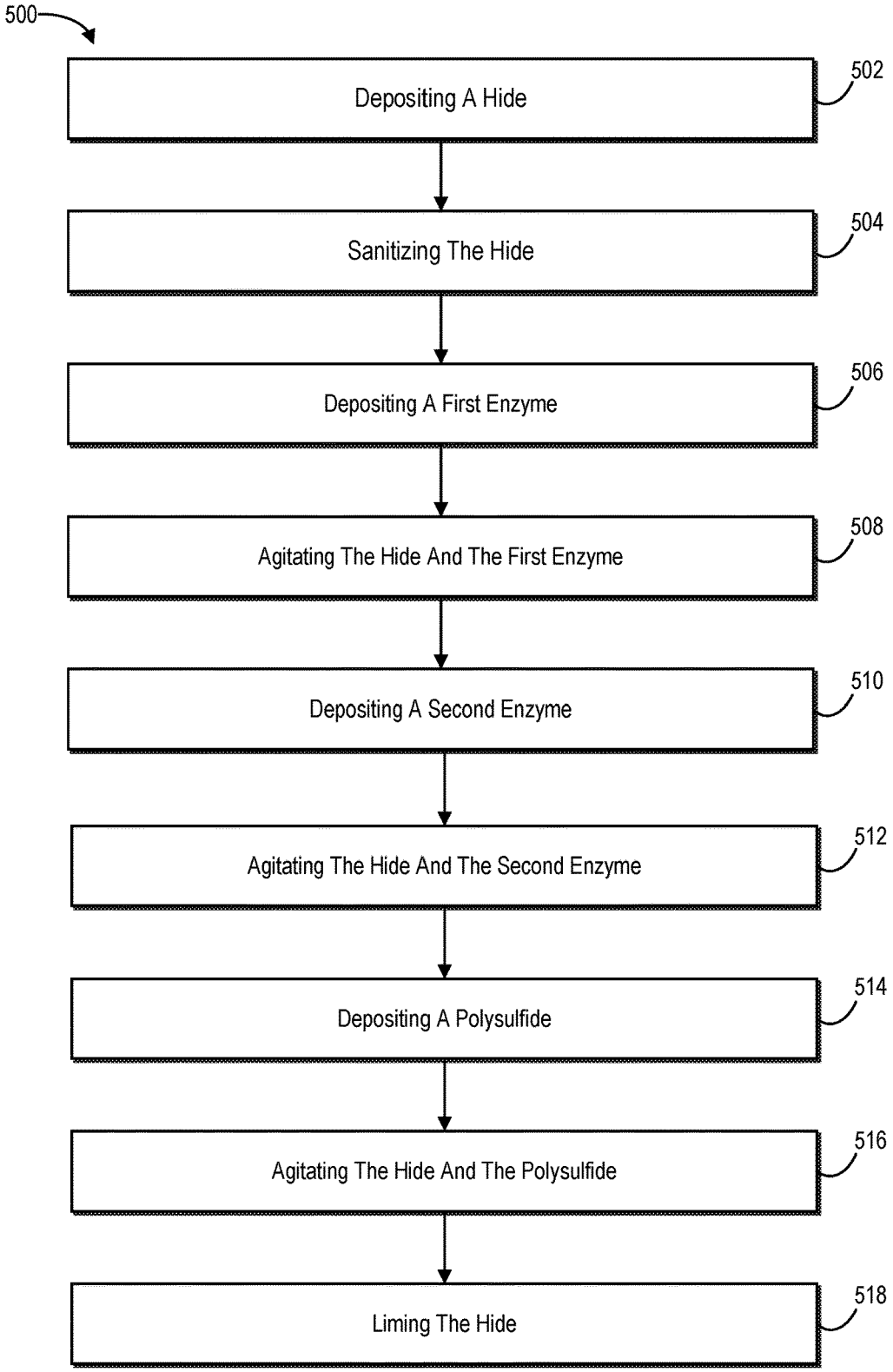
FIG. 5 is a flowchart of steps in a method for preparing an animal hide for chrome tanning in accordance with embodiments of the present invention.
Figure 6:
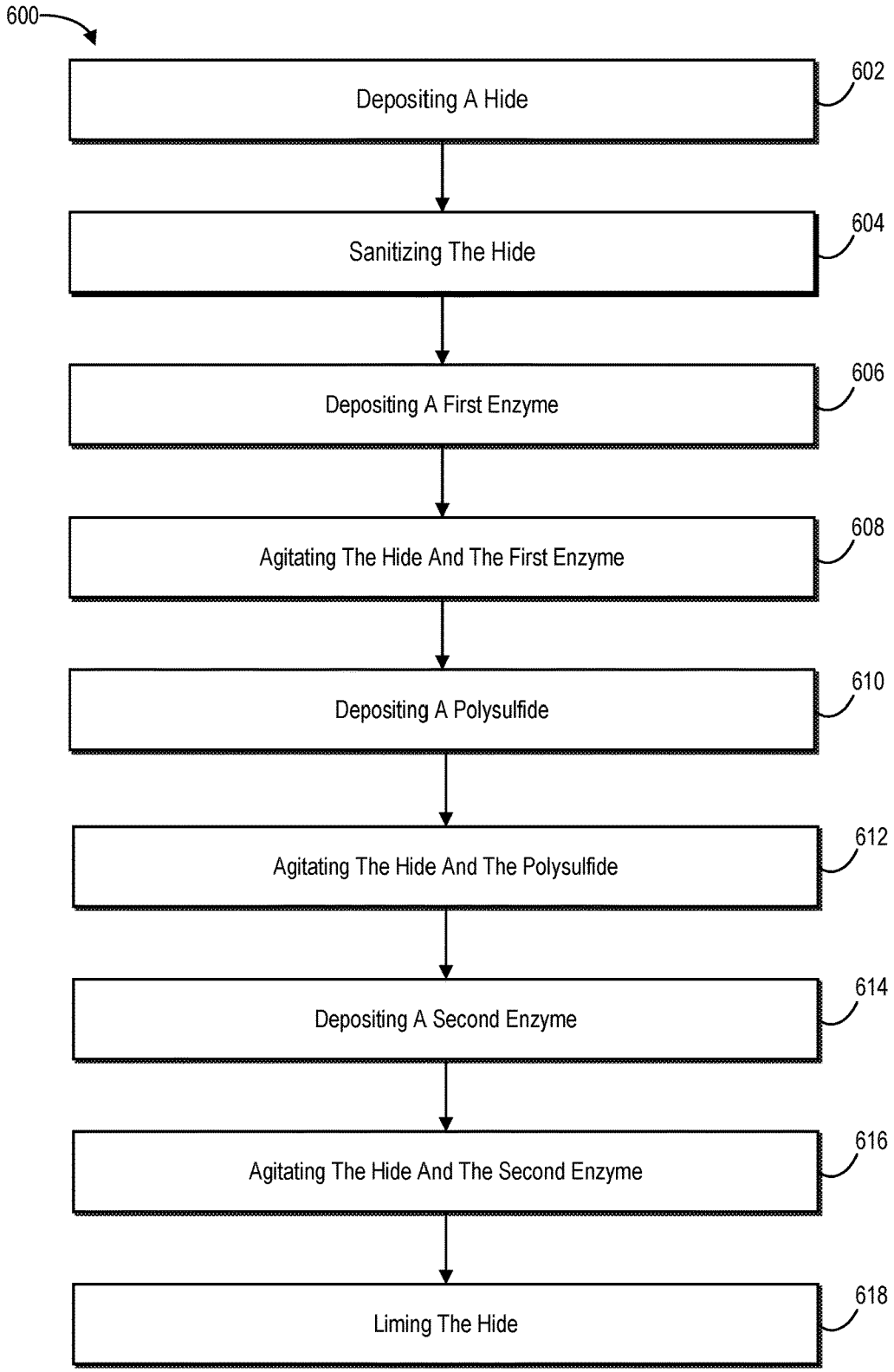
FIG. 6 is a flowchart of steps in a method for preparing an animal hide for chrome tanning in accordance with embodiments of the present invention.

In addition to FIGS. 1-3, embodiments of the present invention can also be described in terms of flowcharts of steps in a method for accomplishing a particular result. For example, FIGS. 4-6 are flowcharts of exemplary methods for preparing an animal hide for chrome tanning in accordance with embodiments of the present invention.

Figure 4:
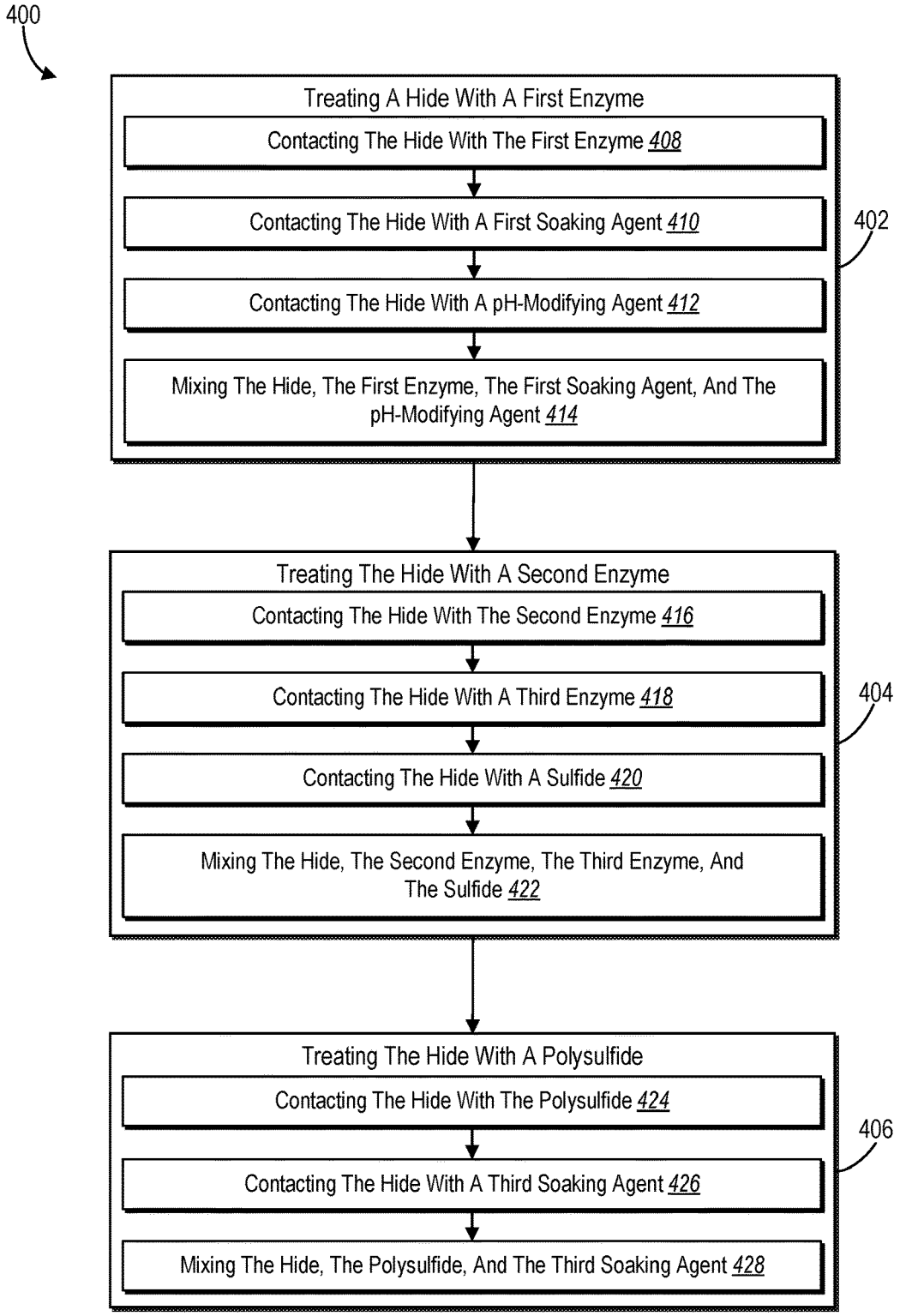
FIG. 4 is a flowchart of steps in a method for preparing an animal hide for chrome tanning in accordance with embodiments of the present invention.

FIG. 4 is a flowchart of one exemplary method 400 for preparing an animal hide for chrome tanning. The method 400 includes a step 402 of treating a hide with a first enzyme. Additionally, method 400 includes a step 404 of treating the hide with a second enzyme. More specifically, step 404 includes a step of treating the hide with a second enzyme after step 402 of treating with the first enzyme. Furthermore, method 400 includes a step 406 of treating the hide with a polysulfide. In particular, step 406 includes a step of treating the hide with a polysulfide after step 402 of treating with the first enzyme.

As used herein, an enzyme includes but is not limited to hydrolase enzymes, such as glycosylases, peptidases, esterases, as well as particular enzymes, such as alpha-amylase, serine endopeptidase, glutamyl endopeptidase, and carboxyl esterase. Moreover, as used herein a polysulfide includes but is not limited to sodium polysulfide, for example as contained in Busperse 7737 by Buckman Laboratories, Inc., and thioglycolic acid sodium salt, for example as contained in Erhavit FA by TFL USA/Canada, Inc. As used herein, a sulfide includes but is not limited to sodium hydrosulfide and any polysulfide. As used herein, a soaking agent means any degreaser, surfactant, emulsifier, penetrator, dispersant, or scud loosening agent, including but not limited to Bemanol DG by Stahl Holdings BV, Busperse 47 by Buckman Laboratories, Inc., and Borron TF355 by TFL USA/Canada, Inc. Also as used herein, a pH-modifying agent means any material that can be used to either raise or lower a pH, including but not limited to soda ash, otherwise known as sodium carbonate. As used herein, a liming agent means lime, also known as milk of lime or diluted calcium hydroxide.

As illustrated by FIG. 4, step 402 includes a step 408 of contacting the hide with the first enzyme. Step 402 also includes a step 410 of contacting the hide with a first soaking agent. Furthermore, step 402 includes a step 412 of contacting the hide with a pH-modifying agent. Step 402 also includes a step 414 of mixing the hide, the first enzyme, the first soaking agent, and the pH-modifying agent. For example, step 414 includes a step of mixing the hide, the first enzyme, and the first soaking agent. Alternatively, step 414 includes a step of mixing the hide, the first enzyme, and the pH-modifying agent.

FIG. 4 also shows that step 404 includes a step 416 of contacting the hide with the second enzyme. Furthermore, step 404 includes a step 418 of contacting the hide with a third enzyme. Additionally, step 404 includes a step 420 of contacting the hide with a sulfide. Step 404 also includes a step 422 of mixing the hide, the second enzyme, the third enzyme, and the sulfide. For example, step 422 includes a step of mixing the hide, the second enzyme, and the third enzyme. Alternatively, step 422 includes mixing the hide, the second enzyme, and the sulfide.

As further illustrated by FIG. 4, step 406 includes a step 424 of contacting the hide with the polysulfide. Step 406 also includes a step 426 of contacting the hide with a third soaking agent. Additionally, step 406 includes a step 428 of mixing the hide, the polysulfide, and the third soaking agent. As an example, step 428 includes a step of mixing the hide, the polysulfide, and the third soaking agent. As another example, step 428 includes a step of mixing the hide and the polysulfide.

Moreover, step 406 of treating the hide with the polysulfide can occur after step 404 of treating the hide with the second enzyme. More specifically, in one or more embodiments step 402 is performed before step 404, which is likewise performed before step 406. In one or more alternative embodiments, step 406 can occur before step 404 of treating the hide with the second enzyme. Step 402 can be performed before step 406, which is performed before step 404.

Additionally, method 400 includes a step of contacting the hide with a pH-modifying agent. Further, method 400 also includes a step of contacting the hide with a first soaking agent. Method 400 also includes a step of contacting a hide with a second soaking agent. Moreover, method 400 includes a step of mixing the hide, the pH-modifying agent, the first soaking agent, and the second soaking agent. More specifically, in one or more embodiments of the present invention, the steps of contacting the hide with the pH-modifying agent, the first soaking agent, and the second soaking agent and mixing the hide with the pH-modifying agent, the first soaking agent, the second soaking agent can occur after step 404 and before step 406.

Furthermore, method 400 includes a step of contacting the hide with a third soaking agent. For example, the step of contacting the hide with the third soaking agent can occur after step 402 and before step 406. In addition, method 400 includes a step of mixing the hide and the third soaking agent. Moreover, method 400 includes a step of contacting the hide with a liming agent. As an example, the step of contacting the hide with the liming agent can occur after step 406 and before step 404. In addition, method 400 includes a step of mixing the hide and the liming agent.

With further reference to FIG. 4, in one or more embodiments of method 400 the first enzyme is alpha-amylase, the second enzyme is glutamyl endopeptidase, the polysulfide is sodium polysulfide, the first soaking agent is Bemanol DG by Stahl Holdings BV, the third enzyme is serine endopeptidase. In one or more alternative embodiments of method 400 the first enzyme is carboxyl esterase, the second ezyme is a peptidase, the polysulfide is thioglycolic acid sodium salt, the pH-modifying agent is soda ash, the sulfide is sodium hydrosulfide, and the third soaking agent is Borron TF355 by TFL USA/Canada, Inc.

Additionally, one or more embodiments of method 400 includes a step of sanitizing the hide before step 402. More specifically, sanitizing the hide includes contacting the hide with one or more of a detergent, a pesticide, and a pH-modifying agent. Moreover, one or more embodiments of method 400 includes a step of liming the hide after step 406. In particular, liming the hide includes the step of contacting the hide with a liming agent. Additionally, liming the hide includes the step of contacting the hide with one or more of a sulfide, sodium sulfide, and a soaking agent. Still further liming the hide includes the one or more steps of contacting the hide with a liming agent and agitating the hide and the liming agent. Also, one or more embodiments of method 400 includes a step of rinsing the hide after step 406 and after the step of liming the hide is complete. As an example, the step of rinsing the hide includes one or more steps of contacting the hide with water.

FIG. 5 is a flowchart of one exemplary method 500 for preparing an animal hide for chrome tanning. The method 500 includes a step 502 of depositing a hide into a treatment container. As used herein, a treatment container means any holder for the hide, including but not limited a tanning drum (e.g., one of liming drums 212*a*-212*b*).

Additionally, the method 500 includes a step 504 of sanitizing the hide. More specifically, the step 504 of sanitizing the hide includes treating the hide with one or more of a detergent, a pesticide, and/or a pH-modifying agent. As one can appreciate, the step 504 of sanitizing the hide can be performed within the treatment container. Alternatively, the step 504 of sanitizing the hide can be performed before the hide is deposited into the treatment container by step 502.

Furthermore, the method 500 includes a step 506 of depositing a first enzyme into the treatment container. More specifically, in one or more embodiments step 506 includes depositing a glycosylase enzyme into the treatment container. Even more specifically, in one or more embodiments step 506 includes depositing an alpha-amylase enzyme into the treatment container.

FIG. 5 further illustrates that method 500 includes a step 508 of agitating the hide and the first enzyme. More specifically, step 508 includes agitating the treatment container for a first duration after steps 502 and 506. In some embodiments, the first duration is in the range of 60 to 300 minutes. In other embodiments, the first duration is preferably 180 minutes. More generally, agitating the treatment container can include moving the treatment container (e.g., rotating one of liming drums 212*a*-212*b* in forward and reverse for a period of time).

Following step 508, method 500 includes a step 510 of depositing a second enzyme into the treatment container. In particular, in one or more embodiments step 510 includes depositing a first peptidase enzyme into the treatment container after step 508. Even more specifically, step 510 includes depositing a glutamyl endopeptidase enzyme into the treatment container.

As also shown by FIG. 5, method 500 includes a step 512 of agitating the hide and the second enzyme. More specifically, step 512 includes agitating the treatment container for a second duration after step 510. In some embodiments, the second duration is in the range of 15 to 45 minutes. In other embodiments, the second duration is preferably 30 minutes.

FIG. 5 also shows that method 500 includes a step 514 of depositing a polysulfide into the treatment container. In particular, step 514 includes depositing a polysulfide into the treatment container after step 512. Furthermore, in one or more embodiments the polysulfide can be sodium polysulfide.

As shown by FIG. 5, method 500 includes a step 516 of agitating the hide and the polysulfide. In particular, step 516 includes agitating the treatment container for a third duration after step 514. In some embodiments, the third duration is in the range of 20 to 100 minutes. In other embodiments, the third duration is preferably 60 minutes.

Moreover, the method 500 includes a step 518 of liming the hide. More specifically, the step 518 of liming the hide includes treating the hide with one or more of a first sulfide, a second sulfide, and/or a first soaking agent after step 516. Step 518 includes treating the hide with a liming agent on one or more occasions after step 516.

Furthermore, method 500 can further include a step of depositing a first soaking agent into the treatment container before step 508. Accordingly, in one or more embodiments step 508 includes mixing the hide, the first enzyme, and the first soaking agent. More specifically, in one or more embodiments step 508 includes mixing the hide, the glycosylase enzyme, and the first soaking agent. Even more particularly, in one or more embodiments step 508 includes mixing the hide, the alpha-amylase enzyme, and the first soaking agent.

Additionally, method 500 includes a step of depositing a third enzyme (e.g., a second peptidase enzyme, such as serine endopeptidase) into the treatment container before step 512. Thus, in some embodiments step 512 includes mixing the hide, the second enzyme, and the third enzyme. More particularly, in some embodiments step 512 includes mixing the hide, the first peptidase enzyme, and the second peptidase enzyme. Even more particularly, in one or more embodiments step 512 includes mixing the hide, the glutamyl endopeptidase enzyme, and the serine endopeptidase enzyme.

Method 500 includes step 504, which can further include depositing a detergent and a pesticide into the treatment container and agitating the treatment container for a fourth duration before step 506, wherein the detergent, the pesticide, and the hide are mixed together. In some embodiments, the fourth duration is in the range of 10 to 30 minutes. In other embodiments, the fourth duration is preferably 30 minutes.

Method 500 also includes step 518, which can further include, after step 516, depositing a first sulfide, a second sulfide, and a first soaking agent into the treatment container and agitating the treatment container for a fifth duration, wherein the first sulfide, the second sulfide, the first soaking agent, and the hide are mixed together. In some embodiments, the fifth duration is in the range of 30 to 90 minutes. In other embodiments, the fifth duration is preferably 60 minutes.

FIG. 6 is a flowchart of one exemplary method 600 for preparing an animal hide for chrome tanning. The method 600 includes a step 602 of depositing a hide into a treatment container. In addition, the method 600 includes a step 604 of sanitizing the hide. In particular, the step 604 of sanitizing the hide includes treating the hide with a one or more of a detergent, a pesticide, and/or a pH-modifying agent. As one can appreciate, the step 604 of sanitizing the hide can be performed within the treatment container. Alternatively, the step 604 of sanitizing the hide can be performed before the hide is deposited into the treatment container by step 602

Furthermore, the method 600 includes a step 606 of depositing a first enzyme into a treatment container. More specifically, in one or more embodiments step 606 includes depositing an esterase enzyme into the treatment container. Even more specifically, in one or more embodiments step 606 includes depositing a carboxyl esterase into the treatment container.

FIG. 6 further illustrates that method 600 includes a step 608 of agitating the hide and the first enzyme. More specifically, step 608 includes agitating the treatment container for a first duration after steps 602 and 606. In some embodiments, the first duration is in the range of 30 to 90 minutes. In other embodiments, the first duration is preferably 60 minutes.

After step 608, method 600 includes a step 610 of depositing a polysulfide into the treatment container. In particular, in one or more embodiments step 610 includes depositing a thioglycolic acid sodium salt into the treatment container after step 608. Even more specifically, step 610 includes depositing a thioglycolic acid sodium salt and a sodium hydroxide into the treatment container after step 608.

As also shown by FIG. 6, method 600 includes a step 612 of agitating the hide and the polysulfide. More specifically, step 612 includes agitating the treatment container for a second duration after step 610. In some embodiments, the second duration is in the range of 15 to 45 minutes. In other embodiments, the second duration is preferably 30 minutes.

FIG. 6 also shows that method 600 includes step 614 of depositing a second enzyme into the treatment container. In particular, in one or more embodiments step 614 includes depositing a proteolytic enzyme into the treatment container after step 612. Even more specifically, step 614 includes depositing a peptidase enzyme into the treatment container after step 612.

As also shown by FIG. 6, method 600 includes a step 616 of agitating the hide and the second enzyme. More specifically, step 616 includes agitating the treatment container for a third duration after step 614. In some embodiments, the third duration is in the range of 10 to 30 minutes. In other embodiments, the third duration is preferably 20 minutes.

Moreover, the method 600 includes a step 618 of liming the hide. More specifically, the step 618 of liming the hide includes treating the hide with a liming agent after step 612 and before step 614. Step 618 includes treating the hide with a liming agent on one or more occasions after step 616.

Furthermore, method 600 includes a step of depositing a pH-modifying agent into the treatment container before step 608. Accordingly, in one or more embodiments step 608 includes mixing the hide, the first enzyme, and the pH-modifying agent. More specifically, in one or more embodiments step 608 includes mixing the hide, the esterase enzyme, and the pH-modifying agent. Even more particularly, in one or more embodiments step 608 includes mixing the hide, the carboxyl esterase enzyme, and soda ash.

In addition, method 600 includes a step of depositing a soaking agent into the treatment container before step 612. Thus, in some embodiments step 612 includes mixing the hide, the polysulfide, and the soaking agent. More particularly, in some embodiments step 612 includes mixing the hide, a thioglycolic acid sodium salt, and the soaking agent. In other embodiments, step 612 includes mixing the hide, a sodium hydroxide, and the soaking agent.

Furthermore, method 600 includes a step of depositing a sulfide into the treatment container before step 616. Accordingly, in some embodiments step 616 includes mixing the hide, the second enzyme, and the sulfide. More specifically, in some embodiments step 616 includes mixing the hide, a proteolytic enzyme, and the sulfide. Even more specifically, in some embodiments step 616 includes mixing the hide, a peptidase enzyme, and sodium hydrosulfide.

Method 600 includes step 604, which can further include depositing a pH-modifying agent and a pesticide into the treatment container and agitating the treatment container for a fourth duration before step 606, wherein the pH-modifying agent, the pesticide, and the hide are mixed together. In some embodiments, the fourth duration is in the range of 14 to 28 minutes. In other embodiments, the fourth duration is preferably 21 minutes.

Method 600 also includes step 618, which can further include, after step 612 and before step 614, depositing a liming agent into the treatment container and agitating the treatment container for a fifth duration, wherein the liming agent, and the hide are mixed together. In some embodiments, the fifth duration is in the range of 5 to 15 minutes. In other embodiments, the fifth duration is preferably 10 minutes.

In the foregoing specification, various embodiments have been described with reference to specific exemplary embodiments thereof. Various embodiments and aspects are described with reference to details discussed herein, and the accompanying drawings illustrate the various embodiments. The description above and drawings are illustrative and are not to be construed as limiting. Numerous specific details are described to provide a thorough understanding of various embodiments.

One or more embodiments of the present invention may be embodied in other specific forms without departing from its spirit or essential characteristics. The described embodiments of the present invention are to be considered in all respects only as illustrative and not restrictive. For example, the methods described herein may be performed with less or more steps or the steps may be performed in differing orders. Additionally, the steps described herein may be repeated or performed in parallel with one another or in parallel with different instances of the same or similar steps. The scope of the invention is, therefore, indicated by the appended claims rather than by the foregoing description. All changes that come within the meaning and range of equivalency of the claims are to be embraced within their scope.

What is claimed is:

1. A method for preparing an animal hide for chrome tanning, the method comprising the steps of:
- treating the hide with a first enzyme, wherein the first enzyme includes:
  - a glycosylase enzyme;
- treating the hide with a second enzyme after the step of treating with the first enzyme, wherein the second enzyme includes a peptidase; and
- treating the hide with a polysulfide after the step of treating with the first enzyme.

2. The method as recited in claim 1, wherein the step of treating with the polysulfide occurs after the step of treating with the second enzyme.

3. The method as recited in claim 2, wherein the step of treating with the first enzyme comprises the steps of:
- contacting the hide with the first enzyme;
- contacting the hide with a soaking agent, wherein the soaking agent includes a degreaser; and
- mixing the hide, the first enzyme, and the soaking agent.

4. The method as recited in claim 3, wherein the step of treating with the second enzyme comprises the steps of:
- contacting the hide with the second enzyme;
- contacting the hide with a third enzyme, wherein the third enzyme includes a second peptidase; and
- mixing the hide, the second enzyme, and the third enzyme.

5. The method as recited in claim 1, further comprising, after the step of treating with the second enzyme and before the step of treating with the polysulfide, the steps of:
- contacting the hide with a pH-modifying agent;
- contacting the hide with a first soaking agent, wherein the first soaking agent includes a first degreaser;
- contacting the hide with a second soaking agent, wherein the second soaking agent includes a second degreaser; and
- mixing the hide, the pH-modifying agent, the first soaking agent, and the second soaking agent.

6. The method as recited in claim 1, wherein the step of treating with the polysulfide occurs before the step of treating with the second enzyme.

7. The method as recited in claim 6, wherein the step of treating with the polysulfide comprises the steps of:
- contacting the hide with the polysulfide;
- contacting the hide with a soaking agent, wherein the soaking agent includes a degreaser; and
- mixing the hide, the polysulfide, and the soaking agent.

8. The method as recited in claim 7, wherein the step of treating with the first enzyme comprises the steps of:
- contacting the hide with the first enzyme;
- contacting the hide with a pH-modifying agent; and
- mixing the hide, the first enzyme, and the pH-modifying agent.

9. The method as recited in claim 1, further comprising the steps of:
- contacting the hide with a soaking agent after the step of treating with the first enzyme and before the step of treating with the polysulfide, wherein the soaking agent includes a degreaser;
- mixing the hide and the soaking agent;
- contacting the hide with a liming agent after the step of treating with the polysulfide and before the step of treating with the second enzyme; and
- mixing the hide and the liming agent.

10. The method as recited in claim 1, wherein the first enzyme also includes at least one of:
- alpha-amylase;
- carboxyl esterase; or
- a hydrolase enzyme.

11. The method as recited in claim 10, wherein the first enzyme includes an esterase enzyme.

12. The method as recited in claim 1, wherein the second enzyme includes a peptidase.

13. The method as recited in claim 12, wherein the second enzyme includes a glutamyl endopeptidase.

14. The method as recited in claim 1, wherein treating the hide with a second enzyme includes:
- contacting the hide with the second enzyme; and
- contacting the hide with a sulfide.

15. The method as recited in claim 14, wherein the sulfide includes:
- sodium hydrosulfide.

16. The method as recited in claim 1, wherein the polysulfide includes:
- sodium polysulfide.

17. The method as recited in claim 1, wherein the polysulfide includes:
- a thioglycolic acid sodium salt.

18. The method as recited in claim 1, further comprising the step of:
- liming the hide after the steps of treating with the second enzyme and treating with the polysulfide.

19. The method as recited in claim 4, wherein the third enzyme includes a serine endopeptidase.

20. The method as recited in claim 8, wherein the pH-modifying agent includes:

soda ash.

* * * * *